US005609036A

United States Patent [19]

Nagasawa et al.

[11] Patent Number: 5,609,036

[45] Date of Patent: Mar. 11, 1997

[54] EVAPORATOR FOR COOLING APPARATUS

[75] Inventors: Toshiya Nagasawa, Obu; Etuo Hasegawa, Kounan; Nobuharu Kakehashi, Toyoake, all of Japan

[73] Assignee: Nippondenso Co., Ltd., Kariya, Japan

[21] Appl. No.: 539,525

[22] Filed: Oct. 6, 1995

[30] Foreign Application Priority Data

Oct. 7, 1994 [JP] Japan ..... 6-244294
May 17, 1995 [JP] Japan ..... 7-118447

[51] Int. Cl.[6] ..... F25B 41/00; F25B 41/04

[52] U.S. Cl. ..... 62/198; 62/225

[58] Field of Search ..... 62/198, 197, 225

[56] References Cited

FOREIGN PATENT DOCUMENTS 6159821A 6/1994 Japan ..... 62/198
6-185831 7/1994 Japan .

*Primary Examiner*—William E. Wayner

*Attorney, Agent, or Firm*—Cushman, Darby & Cushman IP Group of Pillsbury Maidson & Sutro LLP

[57] ABSTRACT

An evaporator for cooling apparatus according to the present invention includes a cooled flow passages in a heat exchanging portion and a bypass flow passage bypassing the heat exchanging portion between a receiver for reducing the pressure (pressure P1) of liquefied refrigerant condensed by a condenser and an evaporator, which communicates in parallel with each other. A valve element is disposed in the bypass flow passage, and opens the bypass passage when the pressure P1 is equal to or less than a predetermined pressure where a refrigerant temperature within the cooled flow passage is more than a refrigerant temperature within a cooling flow passage when the refrigerant is introduced into the heat exchanging portion and where a refrigerant dryness is less than a predetermined value when the refrigerant is not introduced into the heat exchanging portion and pressure thereof is reduced directly to the refrigerant pressure within the evaporating portion. Thereby, the reverse heat exchange is prevented and a good heat exchange efficiency can be achieved for all the range of P1.

9 Claims, 18 Drawing Sheets

EVAPORATOR FOR COOLING APPARATUS

CROSS REFERENCE TO RELATED APPLICATION

The present invention is based on and claims priority from Japanese application Nos 6-244294 filed on Oct. 7, 1994 and 7-118447 filed on May 17, 1995, the subject matter of which are incorporated herein by reference.

BACKGROUND OF THE INVENTION

1. Field of the Invention

The present invention generally relates to an evaporator for cooling apparatus used in refrigerating cycle, and more particularly to an evaporator for cooling apparatus in which a plurality of refrigerant flow passages are connected in parallel with each other.

2. Related Art

A conventional apparatus of this kind of the evaporator for cooling apparatus includes an evaporating portion in which inflow passages and outflow passages are connected in parallel to each other with a plurality of refrigerant flow passages, a heat exchanging portion for heat exchanging between cooled flow passages which lead to a pressure reducing valve in a refrigerating cycle and cooling flow passages which lead to outflow passages for introducing the refrigerant into an outlet, pressure reducing means for reducing the refrigerant pressure within the cooled flow passages and introducing the refrigerant into the inflow passages, and a bypass flow passage for bypassing the heat exchanging portion and the pressure reducing means for introducing the refrigerant into the inflow passages in the evaporating portion.

In this evaporator for cooling apparatus, after the pressure of the refrigerant having been condensed by a condenser in the refrigerating cycle is reduced by a pressure reducing valve, the refrigerant is further cooled in the heat exchanging portion. Then, the pressure of the refrigerant is further reduced by the pressure reducing means, and the refrigerant evaporates in the evaporating portion. The refrigerant is introduced into the cooling flow passage in the heat exchanging portion while absorbing evaporation heat from the ambient air. The temperature of the refrigerant having been introduced into the cooling passages is lower than that of the refrigerant within the cooled flow passages. Therefore, such refrigerant absorbs the heat of the refrigerant within the cooled flow passages of heat and is returned into the refrigerating cycle. In this way, in this kind of the evaporator for cooling apparatus, the dryness of the refrigerant to be introduced into the evaporating portion (the ratio of the gas component of the refrigerant) can be reduced and thereby heat exchange efficiency can be improved by providing the heat exchanging portion (so-called "super cool").

Also in this kind of the evaporator for cooling apparatus includes the bypass flow passage bypassing the heat exchanging portion and the pressure reducing means for introducing the refrigerant into the inflow passages in the evaporating portion, thereby the following effects can be obtained. That is to say, when the refrigerant pressure is low at the upstream side of the pressure reducing valve, e.g. when the temperature is low such as in the winter season or when the cooling apparatus is in a trial operation, the temperature of the refrigerant within the cooled flow passages in the heat exchanging portion falls to or below the temperature of the refrigerant within the cooling flow passage; in such a case, so-called reverse heat exchange occurs, i.e., the refrigerant within the cooled flow passages is heated by the refrigerant within the cooling passages; then, the gasification of the refrigerant within the cooled flow passages is facilitated, and it becomes difficult for the refrigerant to flow through the heat exchanging portion; at this time, the refrigerant passed through the bypass flow passage can reach the evaporating portion without the reverse heat exchange; for this reason, as described above, even if the refrigerant pressure at the upstream side of the pressure reducing valve is low, the heat exchange efficiency can be maintained.

Furthermore, another conventional apparatus of this kind of an evaporator for cooling apparatus, as disclosed in the Japanese Unexamined Patent Publication No. 6-185831, includes a valve element which opens when the refrigerant pressure at the upstream side of the pressure reducing valve falls within the bypass flow passage. In this apparatus, when the refrigerant pressure at the upstream of the pressure reducing valve is high enough to prevent the reverse heat exchange, the refrigerant is introduced into the heat exchanging portion, the valve element may close the bypass flow passage to introduce the whole quantity of the refrigerant into the heat exchanging portion. This can further lower the refrigerant dryness and further improve the heat exchange efficiency. Moreover, when the refrigerant pressure at the upstream of the pressure reducing valve is so low, the reverse heat exchange may occur and the valve element opens the bypass flow passage and prevents the reverse heat exchange.

However, if the valve element opens only when the refrigerant pressure at the upstream side of the pressure reducing valve excessively falls, there is a possibility that the bypass flow passage does not open even if the reverse heat exchange occurs in the heat exchanging portion and the heat exchange efficiency of the evaporator for cooling apparatus may be deteriorated. On the other hand, if the valve element is arranged to open when the refrigerant pressure at the upstream side of the pressure reducing valve slightly falls, the following problem occurs. That is to say, the dryness of the refrigerant to be introduced into the evaporating portion through the bypass flow passages is higher than that of dryness of the refrigerant to be introduced into the evaporating portion through the heat exchanging portion unless the reverse heat exchange occurs. This may raise the dryness of the refrigerant to be guided into the evaporating portion, and there is a possibility that the sufficiently uniform supply of the refrigerant into each refrigerant flow passage in the evaporating portion can not be achieved. If this is the case, the sufficient improvement in the heat exchange efficiency in the evaporating portion can not be achieved.

SUMMARY OF THE INVENTION

In view of the above problems, an object of the present invention is to improve the heat exchange efficiency in an evaporator for cooling apparatus including a heat exchanging portion connected to an evaporating portion and a bypass flow passage bypassing the heat exchanging portion for introducing refrigerant into the evaporating portion by properly controlling the opening of the bypass flow passage.

According to the present invention, an evaporator for cooling apparatus includes an evaporating portion having an inflow passage and an outflow passage, the inflow passage communicating in parallel with the outflow passage through a plurality of refrigerant flow passages, a heat exchanging portion having a cooled flow passage arranged to lead to a pressure reducing valve for a refrigerating cycle and a cooling flow passage arranged to lead the outflow passage to introduce a refrigerant outside the heat exchanging portion, heat exchange being performed between the cooled flow passage and the cooling passage, pressure reducing means for reducing a pressure of the refrigerant within the cooled flow passage to introduce the refrigerant to the inflow passage, means for defining a bypass passage bypassing the heat exchanging portion and the pressure reducing means to introduce the refrigerant into the inflow passage, and a valve element disposed in the bypass passage and opening and closing the bypass passage in accordance with a refrigerant pressure at the upstream side of the pressure reducing valve. The valve element opens the bypass passage when the refrigerant pressure at the upstream side of the pressure reducing valve is equal to or less than a predetermined pressure where a refrigerant temperature within the cooled flow passage is more than a refrigerant temperature within the cooled flow passage is more than a refrigerant temperature within the cooling flow passage when the refrigerant is introduced into the heat exchanging portion and where a refrigerant dryness is less than a predetermined value when the refrigerant is not introduced into the heat exchanging portion and pressure thereof is reduced directly to the refrigerant pressure within the evaporating portion.

According to the above configuration, such a valve element opens only when the refrigerant pressure at the upstream side of the pressure reducing valve is equal to or less than the predetermined value, under which the refrigerant temperature within the cooled flow passages is not less than the refrigerant temperature within the cooling flow passages (the reverse heat exchange does not occur) even if the refrigerant is introduced into the heat exchanging portion and the refrigerant dryness is less than a predetermined value even if the refrigerant at the upstream of the pressure reducing valve is not introduced into the heat exchanging portion and the refrigerant pressure is directly reduced to the refrigerant pressure in the evaporating portion.

The predetermined value of the dryness which serves as an upper limit to which the refrigerant is supplied almost uniformly into each refrigerant flow passage in the evaporating portion is almost constantly fixed according to the refrigerant. When the refrigerant pressure at the upstream of the pressure reducing valve is equal to or lower than a certain pressure (hereinafter referred to as "pressure A"), the refrigerant dryness is equal to or lower than the above predetermined value even if the refrigerant is not introduced and the refrigerant pressure is reduced directly to the refrigerant pressure in the evaporating portion. When the refrigerant pressure at the upstream from the pressure reducing valve is equal to or lower than a certain pressure (hereinafter referred to as "pressure B"), it is known that the reverse heat exchange occur when the refrigerant is introduced into the heat exchanging portion.

According to the present invention, when the refrigerant pressure at the upstream of the pressure reducing valve is equal to or less than the predetermined values of the pressures between B and A, the valve element opens the bypass flow passage. In this way, the reverse heat exchange in the heat exchanging portion is prevented, and at the same time, the dryness of the refrigerant to be introduced into the evaporating portion is controlled to be equal to or less than the above predetermined value. Therefore, whatever value the refrigerant pressure at the upstream of the pressure reducing valve takes, the heat exchange efficiency can favorably be improved.

Furthermore, when HFC-134a is used as refrigerant, it is known that if the refrigerant dryness is controlled to be equal to or less than 0.2, the refrigerant within the refrigerant flow passages in the evaporating portion is uniformly distributed. The inventors found that, in the evaporator for cooling apparatus using HFC-134a as refrigerant, when the refrigerant pressure in the evaporating portion is approximately 0.3 MPa and the refrigerant pressure at the upstream from the pressure reducing valve is equal to or less than approximately 0.8 MPa, the refrigerant dryness is 0.2 or less even if the refrigerant is not introduced into the heat exchanging portion and the refrigerant is reduced directly to the refrigerant pressure in the evaporating portion and also that when the refrigerant pressure at the upstream side of the pressure reducing valve is approximately 0.6 MPa or less, the reverse heat exchange occurs when the refrigerant is introduced into the heat exchanging portion. Furthermore, when the above predetermined pressure is set to 0.7±0.1 MPa, whatever value the refrigerant pressure in the upstream side of the pressure reducing valve takes, the heat exchange efficiency can favorably be improved.

Moreover, when the valve element is a constant pressure valve which opens and closes by using the refrigerant pressure at the upstream side of the pressure reducing valve as a pilot valve. In this arrangement, as compared to a case where the refrigerant pressure in the upstream from the pressure reducing valve is detected by a sensor or the like and thereby the valve element is actuated to open and close, the number of parts can be reduced and resultantly the construction can be simplified.

BRIEF DESCRIPTION OF THE DRAWINGS

Other objects, features and characteristics of the present invention as well as the functions of the related parts will become more clear from a study of the following detailed description, the appended claims, and drawings. In the accompanying drawings:

DETAILED DESCRIPTION OF THE PREFERRED EMBODIMENTS

The preferred embodiments of the present invention will now be described with reference to the appended drawings.

Figure 1:
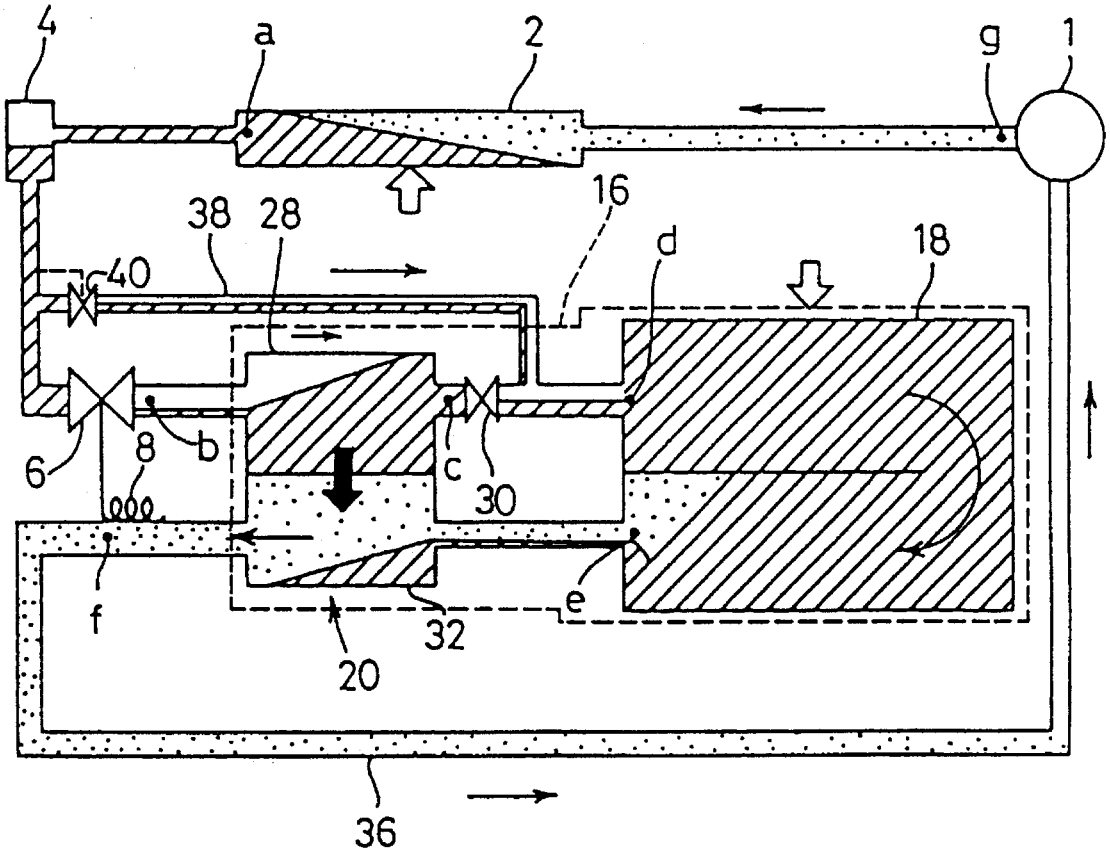
FIG. 1 schematically illustrates the structure of a refrigerating cycle to which an evaporator for cooling apparatus according to the first embodiment is applied.

FIG. 1 schematically illustrates the construction of a refrigerating cycle to which an evaporator for cooling apparatus according to a first embodiment of the present invention is applied. When the evaporator is applied to a vehicle, compressor 1 is rotatably driven by an internal combustion engine (not illustrated). The compressor 1 compresses refrigerant (HFC-134a is used in this embodiment) in the gas state, and supplies the refrigerant into condenser 2. Condenser 2 cools the refrigerant by the outside air into the liquid state, and then supplies the refrigerant into receiver 4.

Figure 2:
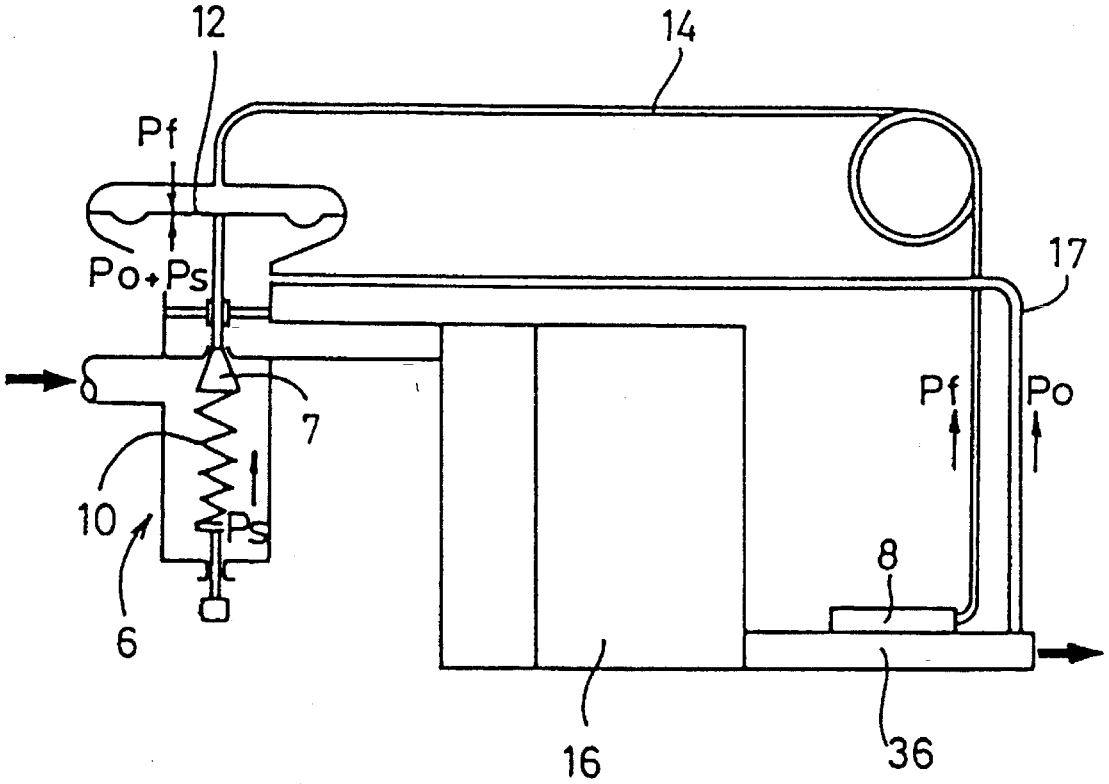
FIG. 2 schematically illustrates the construction of an expansion valve used for such refrigerating cycle.

Receiver 4 temporarily stores the refrigerant and also removes dirt and water from the refrigerant. The refrigerant from receiver 4 is fed into expansion valve 6. Expansion valve 6 reduces the pressure of the received refrigerant. The opening degree of expansion valve 6 is adjustable by the movement of a valve 7, as illustrated in FIG. 2. Expansion valve 6 works as a pressure reducing valve according in this embodiment. However, the pressure reducing valve is not limited to opening degree adjustable type only but may also be fixed throttle type.

In the expansion valve 6, one end of valve 7 is urged in the valve closing direction by the spring force Ps of spring 10, and the other end of valve 7 is engagedly connected to diaphragm 12. Furthermore, thermosensitive tube 8 is provided at the downstream side of the evaporator for cooling apparatus 16 (hereinafter referred simply to "evaporator 16"), which is described later. When the refrigerant temperature at the downstream side of the evaporator rises, the pressure Pf within thermosensitive tube 8 rises. When the cooling load increases, the pressure Pf acts on one side of the diaphragm 12 through a capillary tube 14 and moves the valve 7 in the valve opening direction to adjust the opening degree of the valve in order to increase the refrigerant flow rate.

On the other hand, outer balancing tube 17 is connected to expansion valve 6 to introduce the refrigerant pressure P0 at the downstream side of the evaporator 16 into the other side of the diaphragm 12. The opening degree of valve 7 compensates for the refrigerant pressure and the refrigerant temperature at the downstream side of the evaporator 16 by the balance between the sum of the spring force Ps of spring 10 and the pressure P0 from outer balancing tube 17 and the pressure Pf from capillary tube 14 (Pf=Ps+P0).

Figure 3:
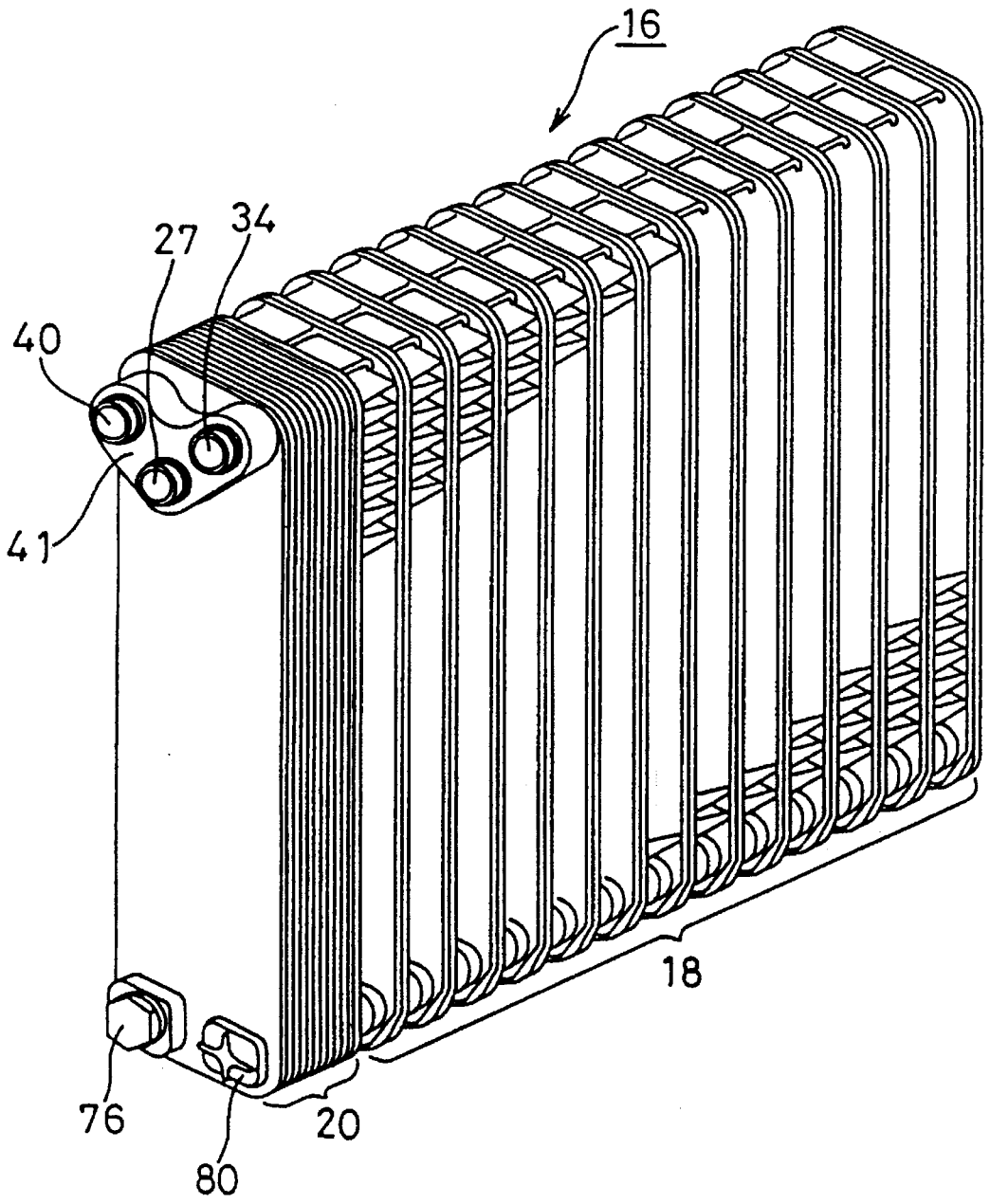
FIG. 3 is a perspective view illustrating the appearance of the evaporator for cooling apparatus according to the first embodiment.
Figure 4:
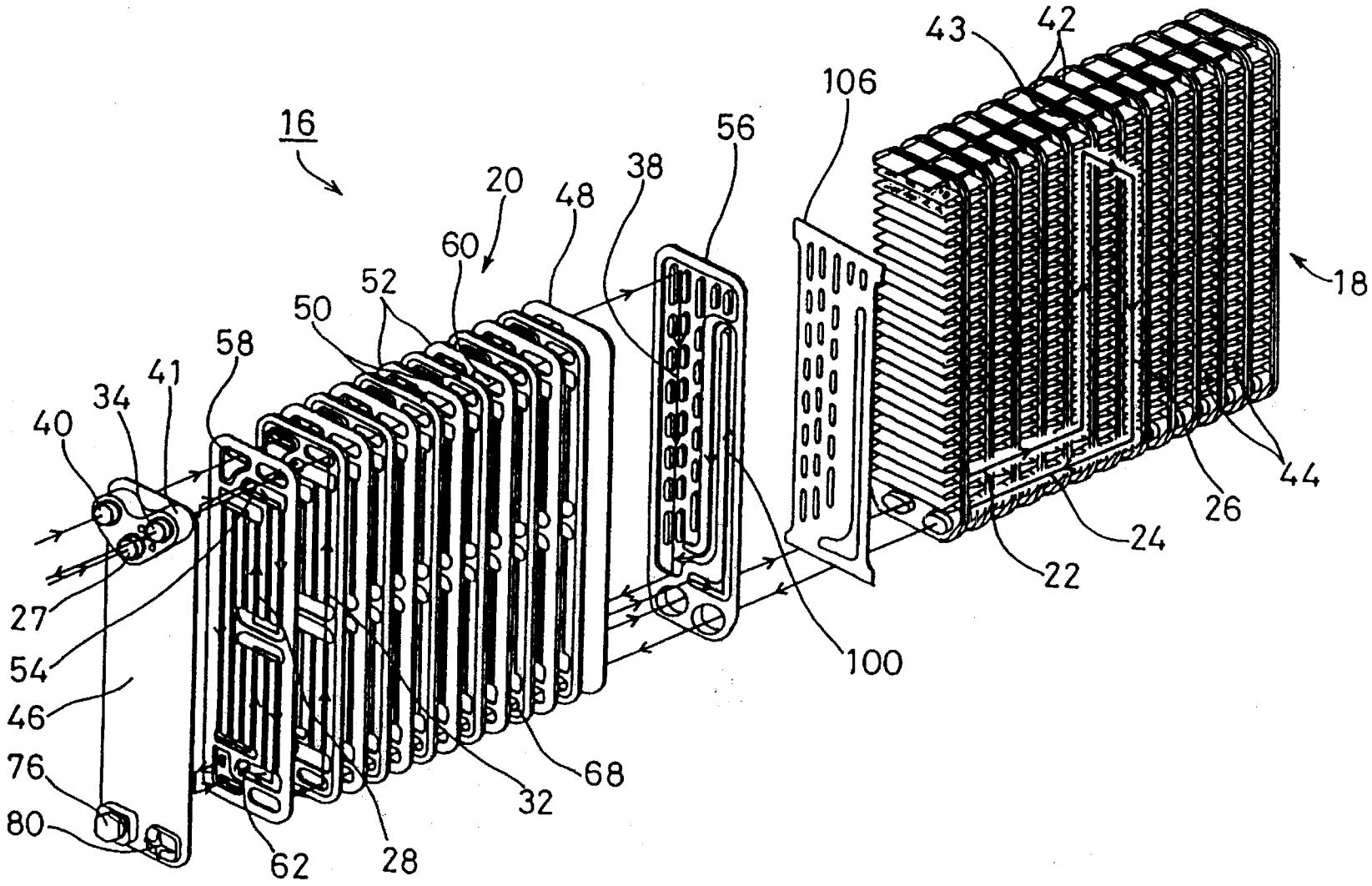
FIG. 4 is a perspective view illustrating the disassembled structure of the evaporator for cooling apparatus according to the first embodiment.

The refrigerant from expansion valve 6 is supplied into evaporator 16 and then, the gaseous refrigerant is sucked into compressor 1. Evaporator 16 includes, as illustrated in FIG. 3, evaporating portion 18 and heat exchanging portion 20. The evaporating portion 18 includes, as illustrated in FIG. 4, inflow passages 22 and outflow passages 24. Both flow passages 22 and 24 are communicated with each other with a plurality of refrigerant flow passages 26 connected in parallel to flow passages 22 and 24. Heat exchange is performed between the refrigerant passing through refrigerant flow passages 26 and the air supplied into a vehicle compartment.

Heat exchanging portion 20 includes a plurality of cooled flow passages 28 which lead from expansion valve 6 through inlet hole 27. The downstream side of the cooled flow passages 28 are joined together at the downstream side, and communicates with the inflow passages 22 through throttle portion 30 (FIG. 1) as pressure reducing means. 0n the other hand, heat exchanging portion 20 includes a plurality of cooling flow passages 32 communicating with outflow passages 24 of evaporating portion 18. Cooling flow passages 32 are joined together at the other end, and communicates with discharge flow passage 36 (FIG. 1) through outlet hole 34. In the heat exchanging portion 20,e alternatingly disposed the cooled flow passages 28 and the cooling flow passages 32 are disposed in turn in such a manner that heat exchange is performed between each pair of flow passages 28 and 32.

In FIG. 2, discharge flow passage 36 is connected to thermosensitive tube 8 and outer balancing tube 17. As illustrated in FIG. 1, discharge flow passage 36 introduces the refrigerant having been discharged from outlet hole 34 into compressor 1.

Furthermore, one end of a bypass flow passage 38 is branchedly connected to a passage between receiver 4 and the heat exchanging portion 20. The other end of the bypass flow passage 38 communicates with the downstream side of throttle portion 30. At the inlet of the bypass flow passage 38, constant pressure valve 40 is provided. Constant pressure valve 40 uses the refrigerant pressure at the upstream side of expansion valve 6 as a pilot pressure and opens when pilot valve becomes 0.7 ±0.1 MPa or less. Constant pressure valve 40 is disposed within block joint 41 (FIG. 4) together with inlet hole 27 and outlet hole 34.

Next, the concrete structure of evaporator 16 will be described referring to FIGS. 4 through 9. As illustrated in FIG. 4, evaporating portion 18 includes a plurality of core plates 42 and 43 forming the refrigerant flow passages 26 which are laminated in turn so as to hold fins 44 therebetween. Furthermore, a plurality of first and second plates 50 and 52 are disposed between side plate 46 and center plate 48. Each shape of the pair of first and second plates 50 and 52 is symmetric.

Figure 5:
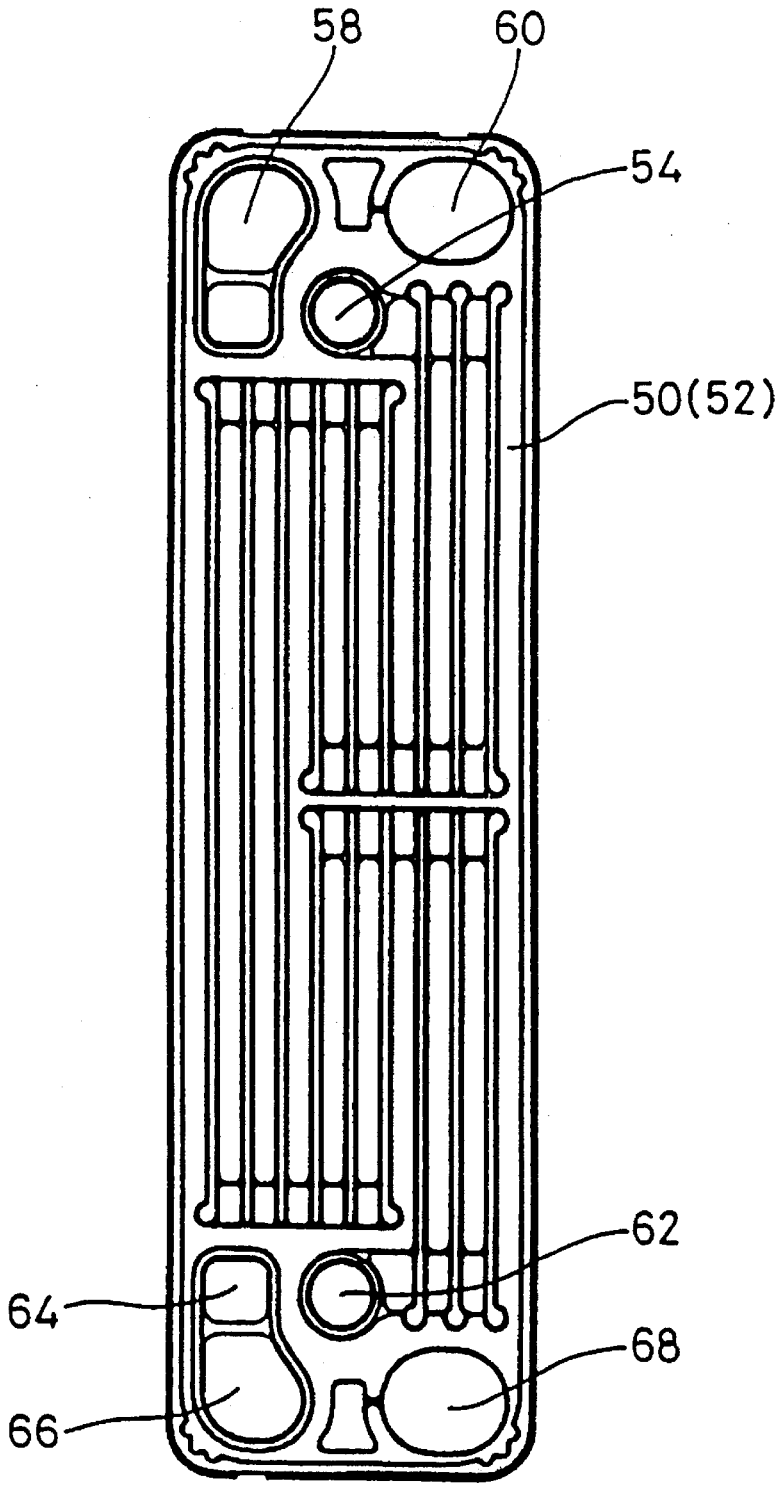
FIG. 5 is a front view illustrating the construction of the first and second plates of the evaporator for cooling apparatus according to the first embodiment.

A plurality of corrugated concave and convex portions are provided on first and second plates 50 and 52 to form cooled flow passages 28 and cooling flow passage 32 as illustrated in FIG. 5. In addition, are made an upper side inflow holes 54 forming refrigerant flow passages communicating the inlet holes 27 with each cooled flow passage 28, bypass holes 58 forming refrigerant flow passages communicating with the constant pressure valve 40 and leading to capillary plate 56, which will be described later, and upper side outflow holes 60 communicating outlet holes 34 with each cooling flow passage 32 are formed in the upper portion of first and second plates 50 and 52. On the other hand, lower side inflow holes 62 communicating each cooled flow passage 28 with capillary plate 56, through holes 64 and 66 communicating capillary holes 62 with capillary plate 56, and lower side outflow holes 68 communicating outflow passages 24 with each cooling flow passage 32 are formed in the lower portion of first and second plates 50 and 52.

Figure 6:
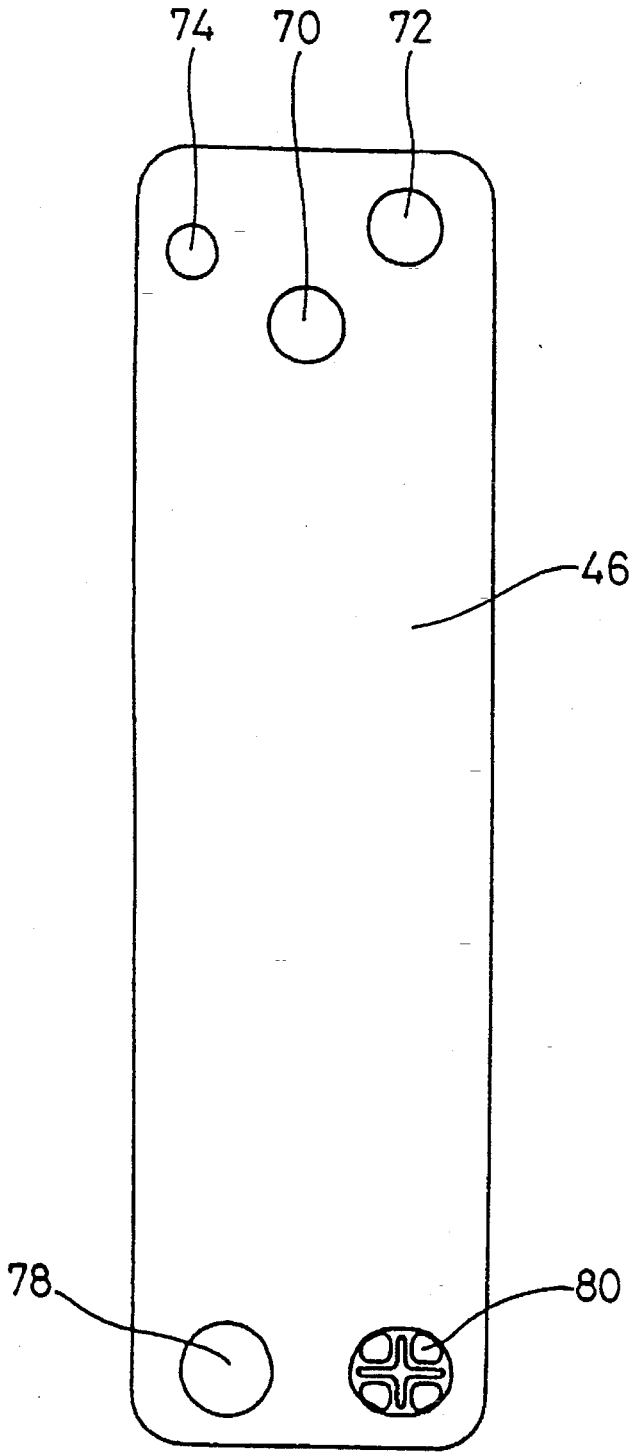
FIG. 6 is a front view illustrating the structure of the side plate of the evaporator for cooling apparatus according to the first embodiment.

As illustrated in FIG. 6, made through holes 70, 72 and 74 are provided in side plate 46 at positions corresponding to inlet hole 27, outlet hole 34 and constant pressure valve 40, respectively. Furthermore, inspection hole 78 into which bolt 76 is inserted and reinforcing rib 80 are provided in side plate 46 at positions corresponding to through holes 64 and 66 in first and second plate 50 and 52, respectively.

Figure 7:
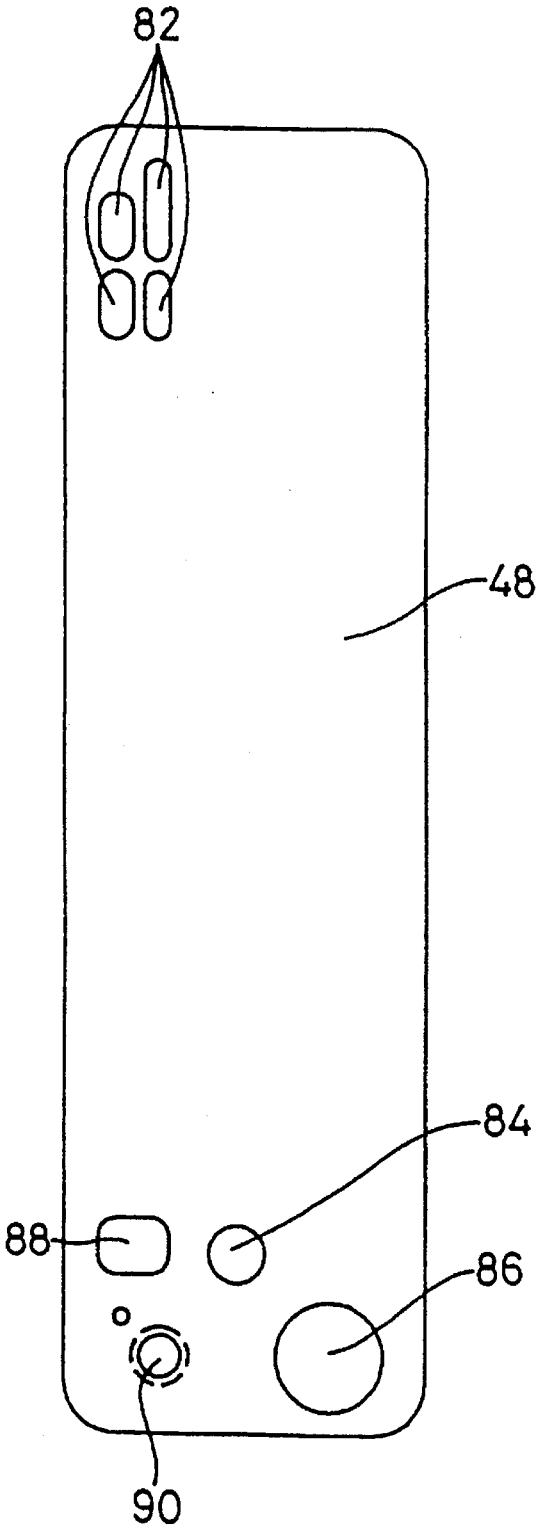
FIG. 7 is a front view illustrating the structure of the center plate of the evaporator for cooling apparatus according to the first embodiment.

Center plate 48 is flat. As illustrated in FIG. 7, through holes 82, 84, 86, 88 and 90 are provided in the center plate 48 at positions corresponding to bypass hole 58, lower side inflow hole 62, lower side outflow hole 68 and through holes 64 and 66, respectively.

Figure 8:
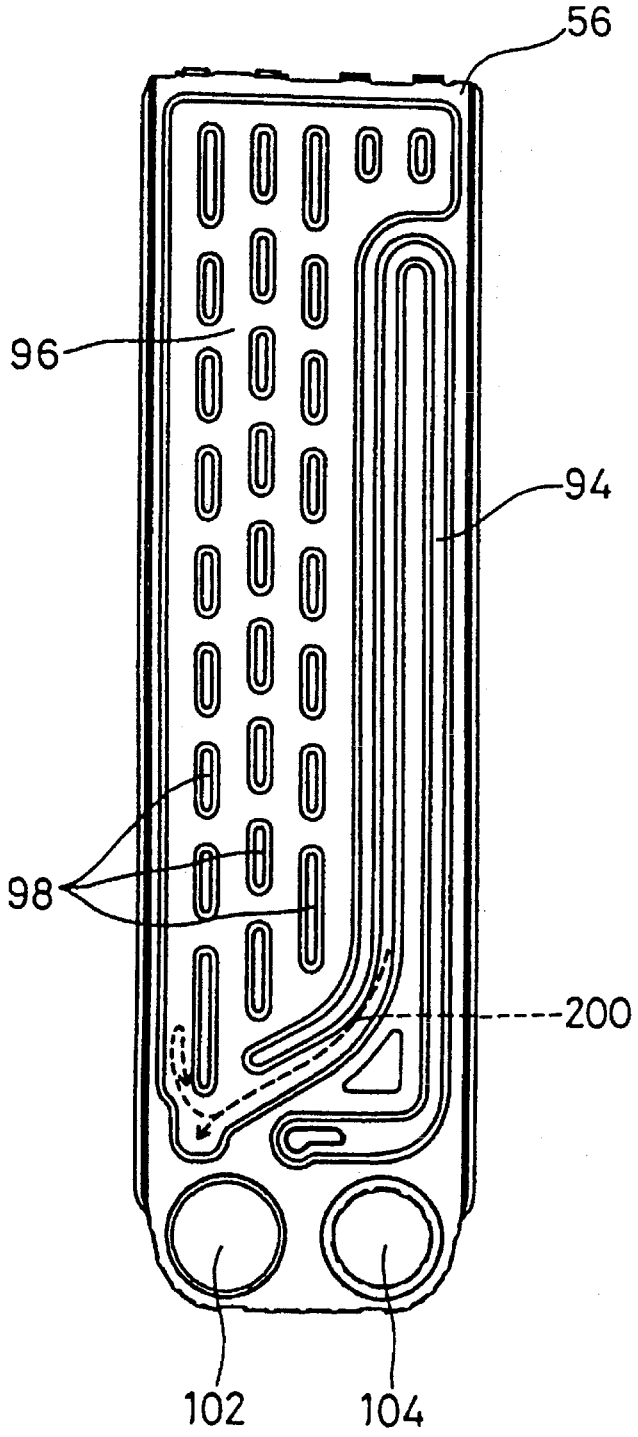
FIG. 8 is a front view illustrating the structure of a capillary plate of the evaporator for cooling apparatus according to the first embodiment.

First and second plates 50 and 52 and the capillary plate 56 are disposed in opposition each other so as to hold center plate 48 therebetween, as illustrated in FIG. 8. To be more specific, throttle portion 30 is formed with fine groove 94 from a portion, which faces lower inflow holes 62 in first and second plates 50 and 52 through center plate 48, to a portion, which faces the through hole 64 through center plate 48. A wide recessed portion 96 is formed from a portion, which faces bypass hole 58 through center plate 48 to a place, which faces to through hole 64 through center plate 48. A plurality of reinforcing ribs 98 On the surface of recessed portion 86. The joint portion of recessed portion 96 and thin groove 94 is disposed at the downstream side of reinforcing ribs 98 (at the side of through hole 64).

For this reason, when capillary plate 56 is joined to center plate 48, capillary flow passage 100 (FIG. 4) is formed as throttle portion 30 between thin groove 94 and center plate 48, and bypass flow passage 38 is formed between recessed portion 96 and center plate 48. Reinforcing ribs 98 are formed on the surface of recessed portion 96. Thus, even if the bypass flow passage is widely formed, a sufficient strength can be maintained. Furthermore, the joint position of bypass flow passage 38 and capillary flow passage 100 is disposed at the downstream side of reinforcing ribs 98. Thus, even if refrigerant jet stream 200 is formed through capillary flow passage 100, there is no possibility that jet stream 200 crashes reinforcing ribs 98 and cause noise.

Through hole 102, which communicates through hole 90 in center plate 48 and through holes 66 in first and second plates 50 and 52 with inflow passages 22 in evaporating portion 18, and through hole 104, which communicates through hole 86 in center plate 48 and lower side outflow holes 68 in first and second plate 50 and 52 with outflow passages 24 in evaporating portion 18, are formed in the lower portion of capillary plate 56.

Figure 9:
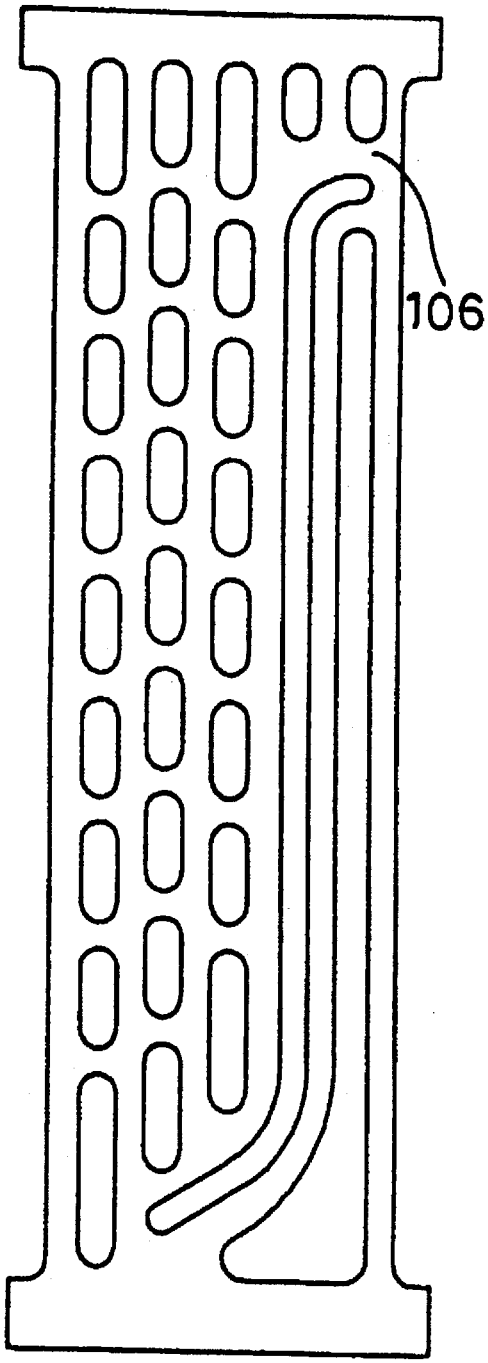
FIG. 9 is a front view illustrating the structure of the reinforcing plate of the evaporator for cooling apparatus according to the first embodiment.

Concave and convex portions, which correspond to the shapes of the recessed part 96 and thin groove 94, are formed on reinforcing plate 106 disposed between capillary plate 56 and evaporating portion 18, as illustrated in FIG. 9. With this construction, when reinforcing plate 106 is joined to capillary plate 56, bypass flow passage 38 and capillary flow passage 100 can be reinforced. Furthermore, the length of reinforcing plate 106 is shorter than those of the other plates 46, 48, 50, 52 and 56, and reinforcing plate 106 are communicated with inflow passages 22 and outflow passages 24 in evaporating portion 18 and through holes 102 and 104 in capillary plate 56 through the lower part of reinforcing plate 106.

Figure 10:
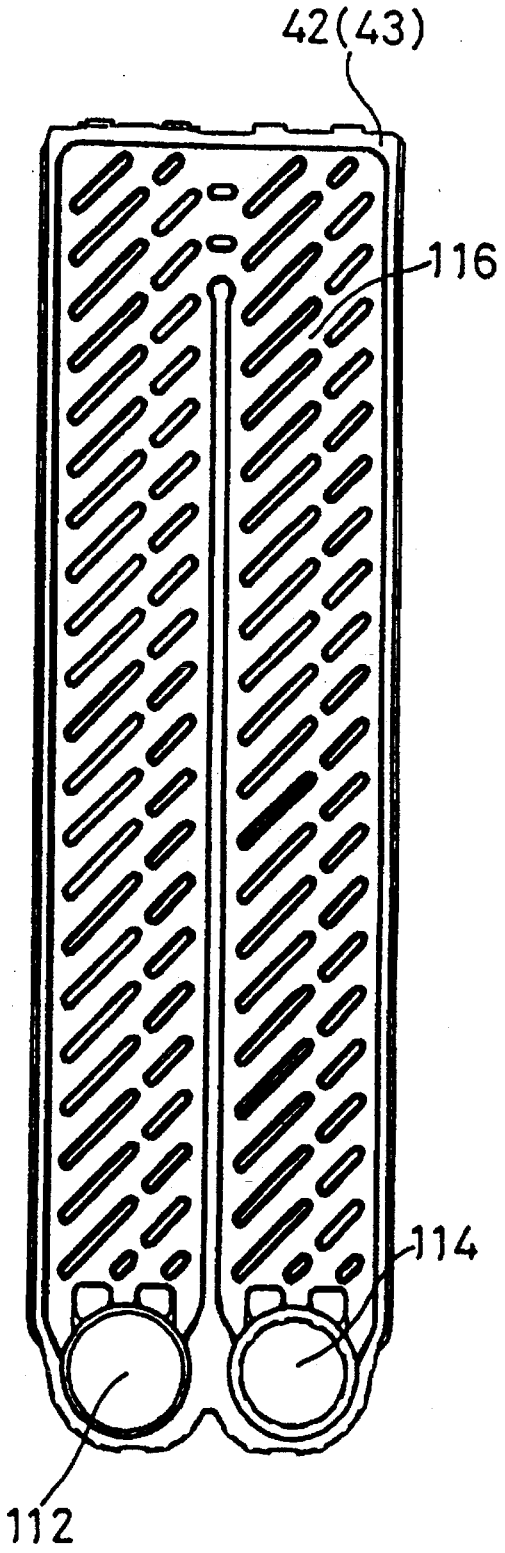
FIG. 10 is a front view illustrating the structure of the core plate of the evaporator for cooling apparatus according to the first embodiment.

As illustrated in FIG. 10, evaporating portion 18 includes core plates 42 and 43. Inflow holes 112 and outflow holes 114 are formed in the lower portions of each of core plates 42 and 43. The shapes of core plates 42 and 43 are symmetric. Inflow holes 112 form inflow passage 22, and outflow holes 114 form outflow passages 24. Each of core plates 42 and 43 includes reverse U-shape recessed portions 116 communicating inflow holes 112 with outflow holes 114. Refrigerant flow passages 26 are formed by joining core plates 42 and 43 in such a manner that each of recessed portions 116 faces. Evaporator 16 in this embodiment is formed by joining each of plates 42, 43, 46, 48, 50, 52, 56 and 106 by brazing.

Next, an operation of evaporator 16 will be described together with the operation of the refrigerating cycle.

Figure 11:
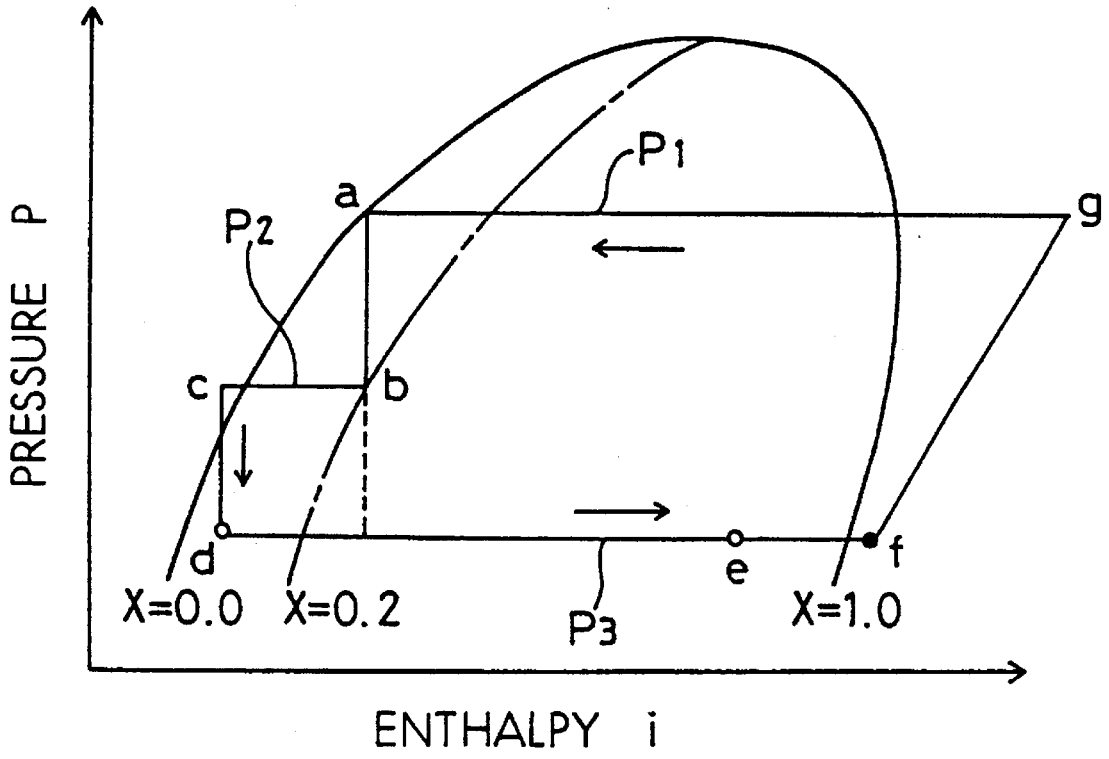
FIG. 11 is a graph illustrating the Mollier diagram of the refrigerating cycle in the summer season according to the first embodiment.

Firstly, the refrigerating cycle in the summer season will be described along with a Mollier diagram illustrated in FIG. 11. When compressor 1 is actuated, the refrigerant in the gas state is sucked thereinto and compressed therewithin (from the point f to the point g) and supplied to condenser 2. In condenser 2, heat exchange is performed between the refrigerant and the air. The high-temperature refrigerant is cooled by the air (from the point g to the point a), and the refrigerant in the liquid state is supplied into receiver 4.

The refrigerant having been supplied into receiver 4 is temporarily stored therein, and then supplied into the constant pressure valve 40 and expansion valve 6. In the summer season, as the refrigerant pressure P1 at the upstream side of expansion valve 6 (from the point g to the point a) is generally much higher than 0.7 MPa (Mega-Pascal), the constant pressure valve 40 is in the almost closed state. Accordingly, almost the whole quantity of the refrigerant flows into expansion valve 6. The opening degree of expansion valve 6 is adjusted according to the balance between the pressure Pf of the thermosensitive tube 8, which is detected through the capillary tube 14 at the lower side of evaporator 16, and the refrigerant pressure P0 at the downstream side of the evaporator 16, which is detected through the spring force Ps of the spring 10 and outer balancing tube 17.

The flow rate of the refrigerant having passed through the expansion valve 6 is adjusted and the pressure of the refrigerant is reduced according to the opening degree of expansion valve 6 (from the point a to the point b). Then, the refrigerant is supplied into inlet holes 27 in evaporator 16. The refrigerant is further cooled through cooled flow passages 28, and reaches capillary flow passage 100 through lower side inflow holes 62 (from the point b to the point c). Then, the pressure of refrigerant is reduced through capillary flow passage 100, and the refrigerant is supplied into inflow passages 22 in evaporating portion 18 through holes 64 and 66 (from the point c to the point d). The refrigerant having been supplied into inflow passages 22 is branched into each refrigerant flow passage 26. As long as the refrigerant is within refrigerant flow passages 26, heat exchange is performed between the refrigerant and the air through the respective core plates 42 and 43 and the fins 44, and the air to be supplied into the vehicle compartment is cooled (from the point d to the point e).

The refrigerant having passed through refrigerant flow passages 26 and having been supplied into outflow passages 24 passes through cooling flow passages 32 via the lower side outflow holes 68. After the refrigerant absorbs heat of the refrigerant within the cooled flow passages 28, the refrigerant is discharged into discharge flow passage 36 through upper side outflow hole 60 and outlet hole 34 (from the point e to the point f). This is to say, when the refrigerant flows through cooling flow passages 32, heat exchange is performed between the refrigerant within cooling flow passages 32 and the refrigerant within cooled flow passage 28. As a result, the refrigerant passing through cooling flow passages 32 is heated (from the point e to the point f) into the overheated vapor, while the refrigerant passing through the cooled flow passage 28 is cooled (from the point b to the point c) and the refrigerant in the double phases of gas and liquid after the refrigerant passing through expansion valve 6 is liquefied.

In this way, the liquefaction of the refrigerant flowing through cooled flow passages 28 into a single phase refrigerant in the liquid state is facilitated, and the refrigerant is supplied into inflow passages 22 in evaporating portion 18 through capillary flow passage 100. For this reason, the dryness x of the refrigerant on the point d in FIG. 11 becomes 0.2 or less. Here, it is empirically known that when HFC-134a is used as refrigerant and x is set to be equal to or less than 0.2($X \leqq 0.2$), the refrigerant is equally distributed into each refrigerant flow passage 26. This prevents uneven cooling of the air passing between each of core plates 42 and 43. That is to say, as the refrigerant is in the single-phase liquid state, the refrigerant can almost equally be distributed from inflow passages 2 into each refrigerant flow passage 26 without providing any throttle or the like for distribution.

The refrigerant having been supplied from cooling flow passages 32 into outlet hole 34 is further supplied from discharge flow passage 36 into compressor 1. In the example illustrated in FIG. 11, the pressure P1 of condenser 2 is set to 1.0 MPa and the pressure P3 of evaporating portion 18 is set to 0.3 MPa, the pressure P2 of cooled flow passages 28 is 0.6 MPa.

On the other hand, in the recent air conditioning for vehicles, even in the winter season, the refrigerating cycle is performed to dehumidify the air, and then the air is heat by a heater (not illustrated). When the temperature of the air passing through condenser 2 is as low as 0° to 10° C. as is in the winter season, the refrigerant having been pressurized by compressor 1 (from the point f to the point g) is supplied into condenser 2. The refrigerant is then cooled by heat exchange so that the refrigerant in the liquid state (from the point g to the point a). However, because the ambient temperature is low, liquefaction is facilitated and the refrigerant tends to be stagnant within condenser 2. For this reason, the pressure P1 at the outlet of condenser 2 falls. Then, as illustrated in the Mollier diagram in FIG. 12, the refrigerant having been supplied from receiver 4 is not introduced into heat exchanging portion 20, and even if the refrigerant pressure is directly reduced to the pressure P3 by constant pressure valve 40, the dryness x of the refrigerant becomes 0.2 or less (from the point a to the point d). As a result, even if the whole quantity of the refrigerant is introduced into evaporating portion 18 through bypass flow passage 38, a good heat exchange efficiency can be obtained.

When the pressure P1 of condenser 2 further falls and the refrigerant passes through heat exchanging portion 20, a reverse heat exchange occurs. That is to say, as illustrated in the Mollier diagram in FIG. 13, the liquefied refrigerant passes through receiver 4, the pressure of the refrigerant is reduced by expansion valve 6 (from the point a to the point b), and the refrigerant is supplied to cooled flow passages 28 in heat exchanging portion 20. Then, the refrigerant is supplied into inflow passages 22 in evaporating portion 18 through throttle portion 30 (capillary flow passage 100) (from the point c to the point d). At this time, the refrigerant pressure is low, and the refrigerant quantity is small. The refrigerant having been supplied into inflow passages 22 is distributed into each refrigerant flow passage 26, and heat exchange is performed between the refrigerant and the air. The temperature of the air within the vehicle compartment being heated by the heater (not illustrated) is as high as 25° C., for example, and the refrigerant becomes overheated vapor and is supplied into outflow passages 24 (from the point d to the point e).

Heat exchange is performed between and the refrigerant having been supplied from outflow passages 24 into cooling flow passages 32 of heat exchanging portion 20 and the refrigerant within the cooled flow passages 28. At this time, the refrigerant within cooled flow passages 28 is heated (from the point b to the point c), while the refrigerant within the cooling flow passage 32 is cooled (from the point e to the point f), because the temperature of the refrigerant within cooling flow passages 32 is higher than that of the refrigerant within cooled flow passages 28.

When the refrigerant within cooled flow passages 28 is heated, the gasification of the refrigerant is facilitated. Thus, it is difficult for the refrigerant to pass through cooled flow passages 28. At this time, the refrigerant within the cooling flow passages 32 is cooled, thereby the refrigerant temperature detected by thermosensitive tube 8 falls, the opening degree of expansion valve 6 decreases so that the refrigerant flow rate decreases. When such reverse heat exchange occurs, the heat exchange efficiency of refrigerating cycle is lowered. It should be noted that such reverse heat exchange occurs not only when the refrigerant temperature is low but also when the refrigerant quantity is small and therefore the pressure P1 is low like when the vehicle is in a trial operation.

Figure 12:
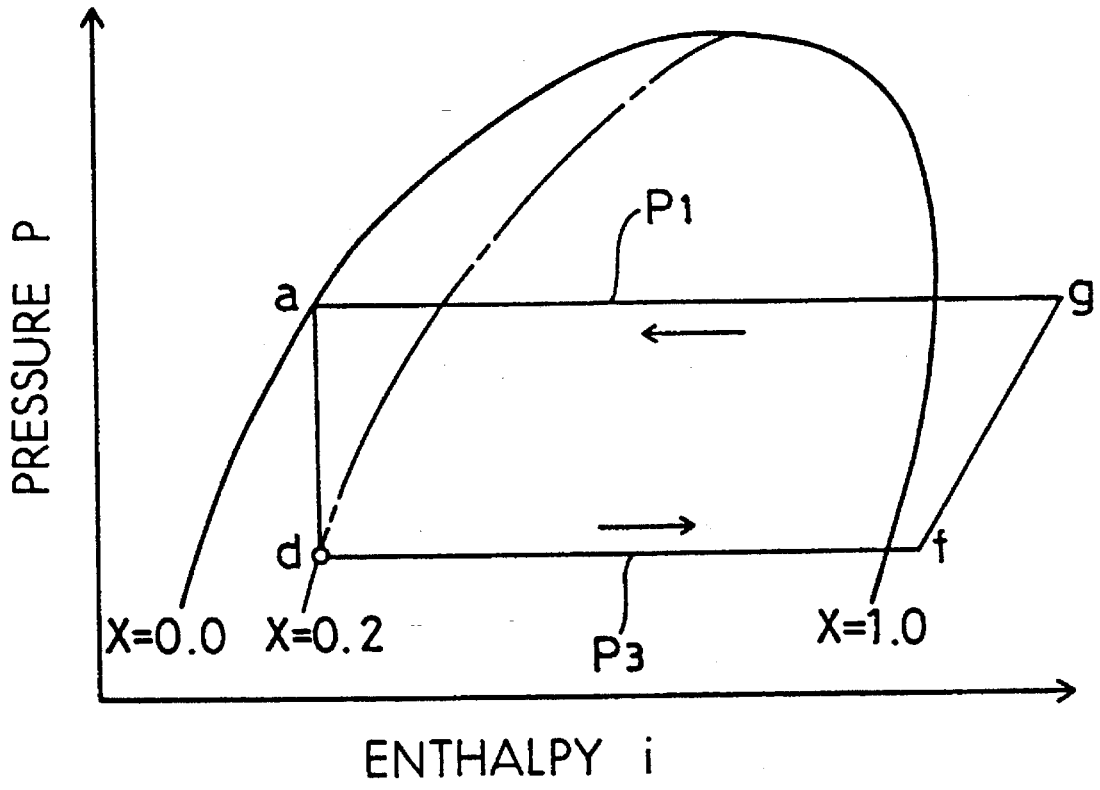
FIG. 12 is a graph illustrating the Mollier diagram of the refrigerating cycle in the winter season according to the first embodiment.
Figure 13:
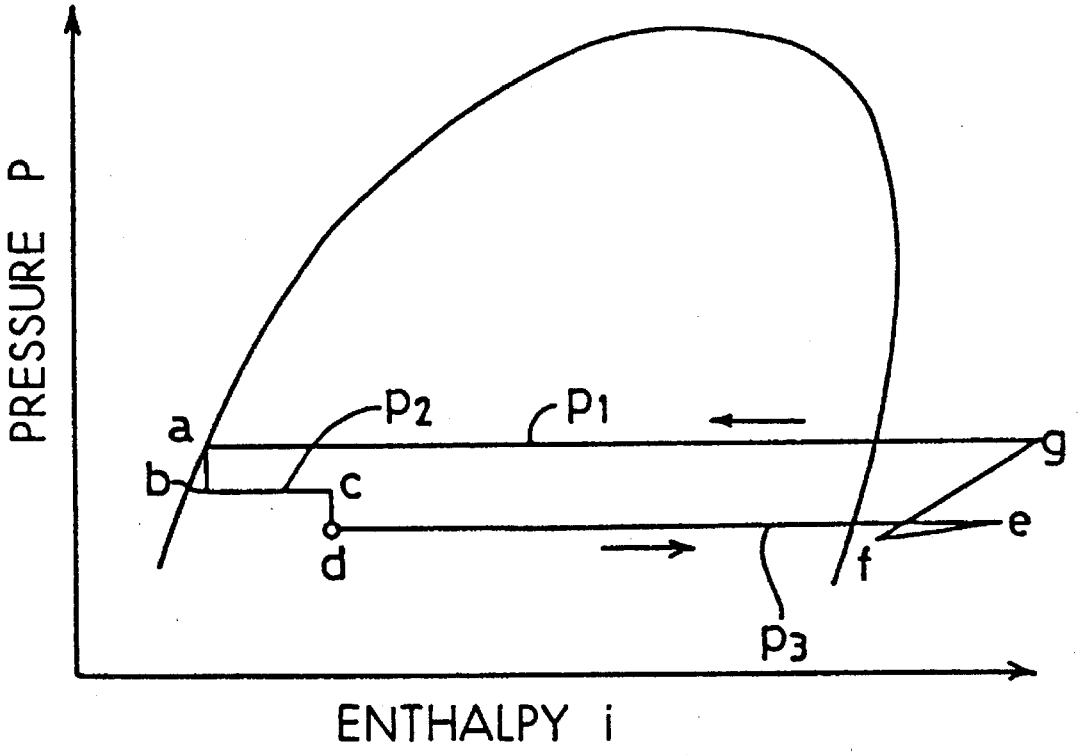
FIG. 13 is a graph illustrating the Mollier diagram of the refrigerating cycle in case that a reverse heat exchange occurs according to the comparison example.

In evaporator 16 using HFC-134a as refrigerant, when the refrigerant pressure of evaporating portion 18 is approximately 0.3 MPa, if the pressure P1 is equal to or lower than 0.8 MPa ($P1 \leqq 0.8$ MPa), the following state occurs. That is to say, as illustrated in FIG. 12, it is known that even if the refrigerant is not introduced into the heat exchanging portion 20 and the refrigerant pressure is reduced directly to the pressure P3 of evaporating portion 18, the refrigerant dryness x is equal to or lower than 0.2($X \leqq 0.2$). When the pressure P1 of condenser 2 is equal to or lower than 0.6 MPa ($P1 \leqq 0.6$ MPa), the following state occurs. That is to say, as illustrated in FIG. 13, it is known that when the refrigerant is introduced into the heat exchanging portion 20, the reverse heat exchange occurs.

According to this embodiment, when the pressure P1 becomes equal to or lower than 0.7±0.1 MPa ($P1 \leqq 0.7 \pm 0.1$ MPa), constant pressure valve 40 opens and subsequently bypass flow passage 38 opens, and when the pressure P1 becomes higher than this pressure level, constant pressure valve 40 opens and the whole quantity of the refrigerant is introduced into heat exchanging portion 20. For this reason, the reverse heat exchange in heat exchanging portion 20 is prevented, and at the same time, the dryness x of the refrigerant to be introduced into evaporating portion 18 is set to 0.2 or less. Accordingly, whatever value the pressure P1 takes, the heat exchange efficiency can favorably be improved.

Furthermore, in this embodiment, the flow passage area of the bypass flow passage 38 can be increased while the sufficient strength is maintained, because the reinforcing ribs 98 are formed on the recessed part 96 of the capillary plate 56. For this reason, when the constant pressure valve 40 opens, the refrigerant can smoothly flow through the bypass flow passage 38, and therefore the heat exchange efficiency can further be improved because the reinforcing ribs 98 are formed on the recessed part 96 of the capillary plate 56.

Also in this embodiment, as well as the recessed part 96 and the reinforcing ribs 98, the thin groove 94 is formed by press working on capillary plate 56. Bypass flow passage 38 and capillary flow passage 100 are formed by joining capillary plate 56 to center plate 4. Thus, it is easy to form bypass flow passage 38 and capillary flow passage 100, and therefore the manufacturing procedures can be simplified, and thereby the manufacturing cost can be lowered.

In the above embodiment, although throttle portion 30 (capillary flow passage 100) is used as pressure reducing means for reducing the pressure of the refrigerant within cooled flow passages 28, the other various types of the pressure reducing means can also be employed.

Figure 14:
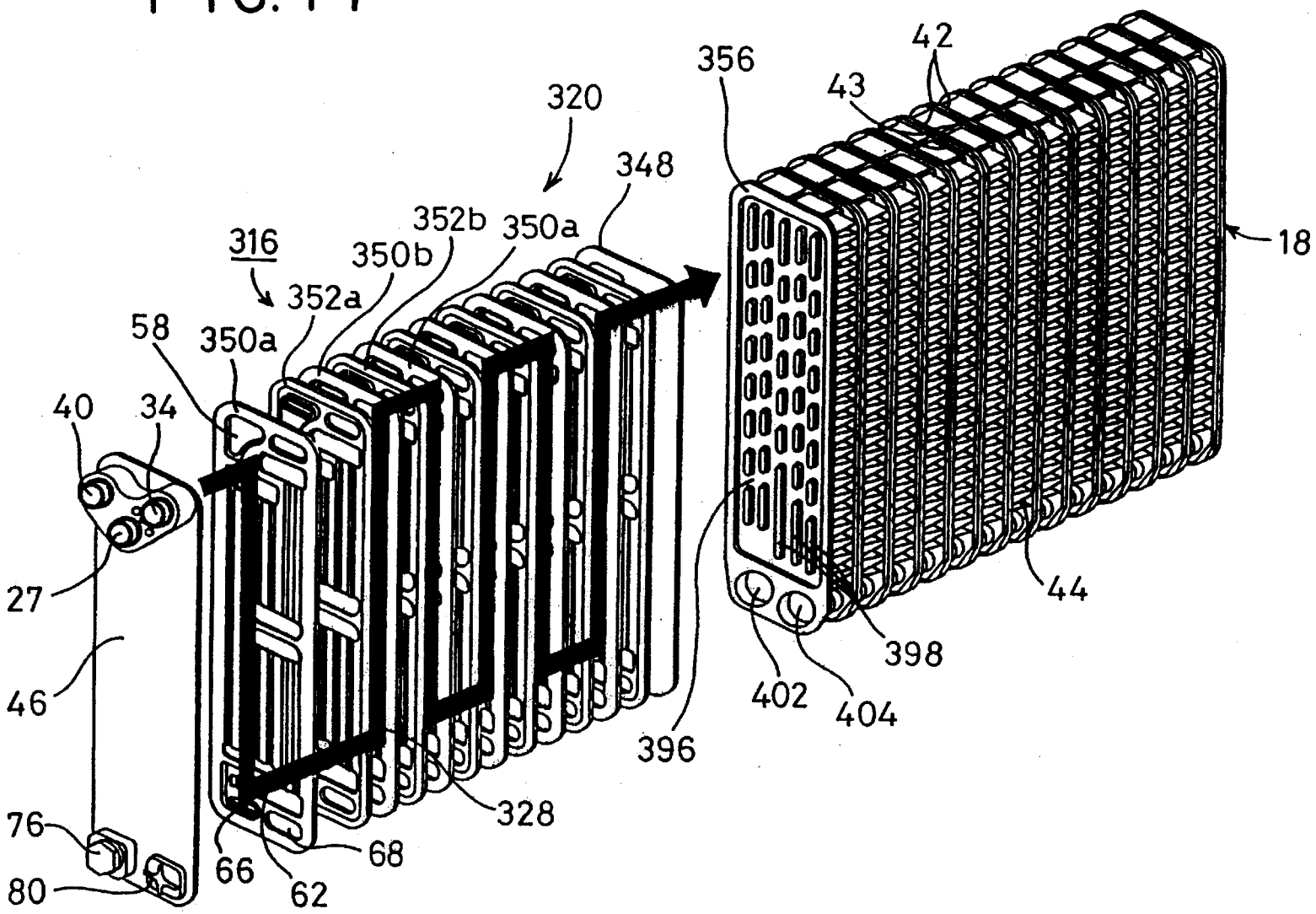
FIG. 14 is a perspective view illustrating the disassembled structure of an evaporator for cooling apparatus according to the second embodiment.

FIG. 14 illustrates a perspective view of disassembled construction of evaporator 316 according to a second embodiment of the present invention. In this embodiment, the same reference numerals as the first embodiment will be applied to those parts constructed in the same way as the first embodiment and the detailed description of those parts will be omitted.

Figure 15:
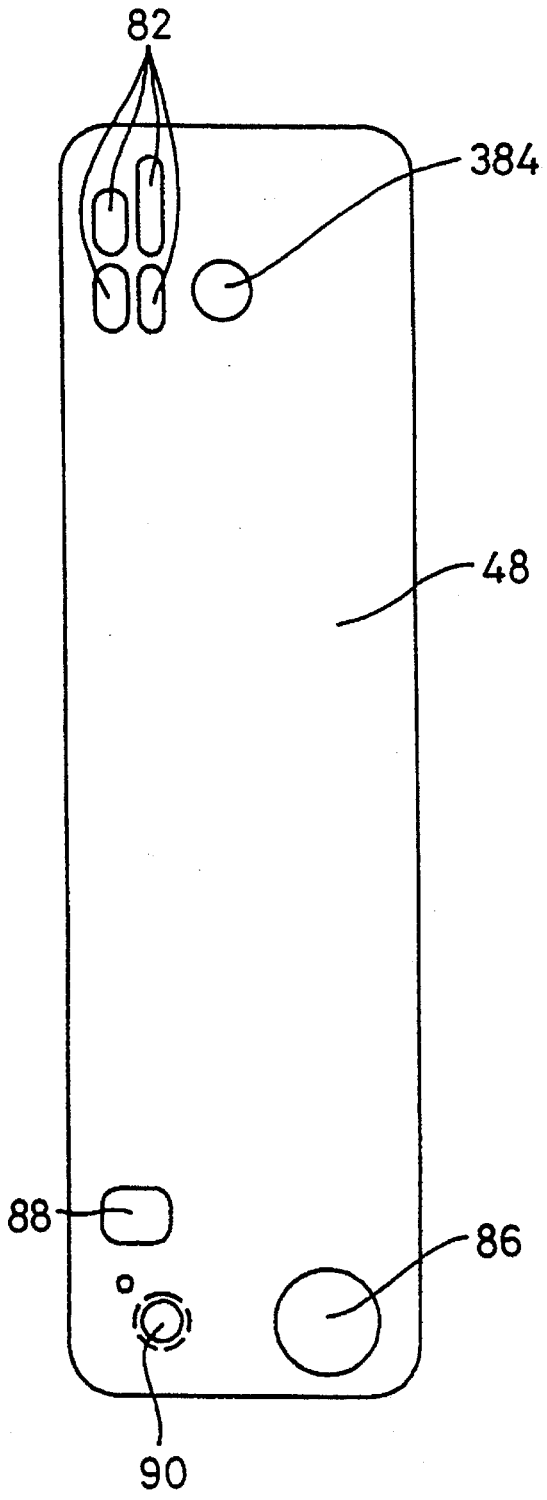
FIG. 15 is a front view illustrating the structure of the center plate of the evaporator for cooling apparatus according to the second embodiment.

According to the second embodiment, a plurality of sets of first, second, third and fourth plates 350*a*, 352*a*, 350*b* and 352*b* are laminated between the side plate 46 and a center plate 348 in this order. First plate 350*a* is formed into a shape like upper side inflow hole 54 in first plate 50 of the first embodiment were closed, second plate 352*a* is formed into a shape like upper inflow hole 54 in second plate 52 of the first embodiment were closed, the third plate 350*b* is formed into a shape like lower side inflow hole 62 of the first embodiment were closed, and the fourth plate 352*b* is formed into a shape like lower side inflow hole 62 of the first embodiment were closed. Center plate 348 is, as illustrated in FIG. 15, different from the center plate of the first embodiment in that through hole 384 is formed at a position corresponding to upper side inflow hole 54 instead of through hole 84.

Back to FIG. 14, fifth plate 356 corresponding to capillary plate 56 of the first embodiment does not include thin groove 94 forming throttle portion 30 (capillary flow passage 100) but includes recessed portion 396 forming bypass flow passage 38 (FIG. 16) and reinforcing ribs 398 for reinforcing the recessed portion 396. Furthermore, through hole 402, which communicates the through holes 66 in first through fourth plates 350*a* through 352*b* with inflow passages in evaporating portion 18, and through hole 404, which communicates lower side outflow holes 68 in first through fourth plates 350*a* through 352*b* with outflow passages in evaporating portion 16 in the lower portion of fifth plate 356.

Heat exchanging portion 320 of evaporator 316 is the same as the first embodiment in that cooled flow passages 328 (the layout and direction thereof are schematically illustrated in FIG. 14) are formed between first through fourth plates 350*a* through 352*b* at every two plates. However, cooled flow passages 328 are formed entirely downward between first plate 350*a* and side plate 46 and between fourth plate 352*b* and first plate 350*a* and entirely upward between second plate 352*a* and third plate 350*b*. Moreover, the whole cooled flow passage 328 forms a continuous single flow passage.

In this way, flow resistance applied on the refrigerant flowing through cooled flow passages 328 is much larger as compared to cooled flow passages 28 of the first embodiment. Therefore, due to this flow resistance, the refrigerant pressure falls to the pressure P3. That is to say, in the second embodiment, cooled flow passage 328 functions as the pressure reducing means.

Figure 16:
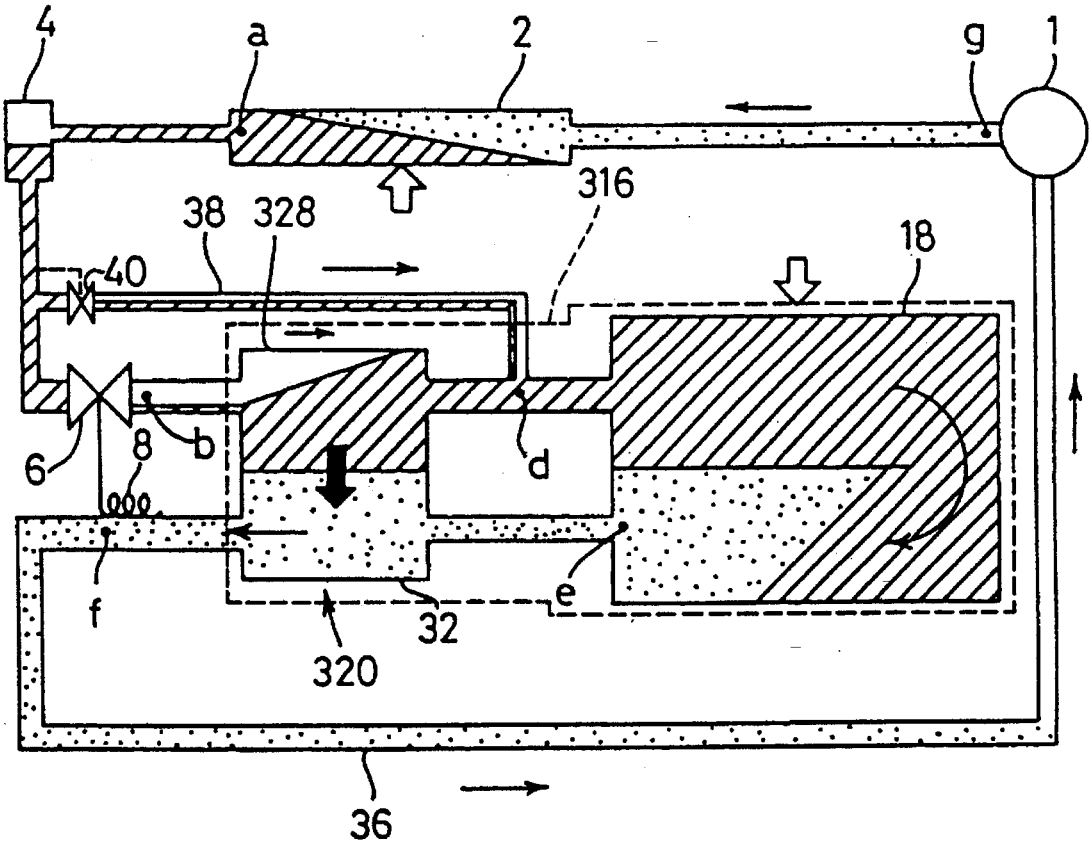
FIG. 16 is a schematic illustrating the construction of a refrigerating cycle to which the evaporator for cooling apparatus according to the second embodiment is applied.
Figure 17:
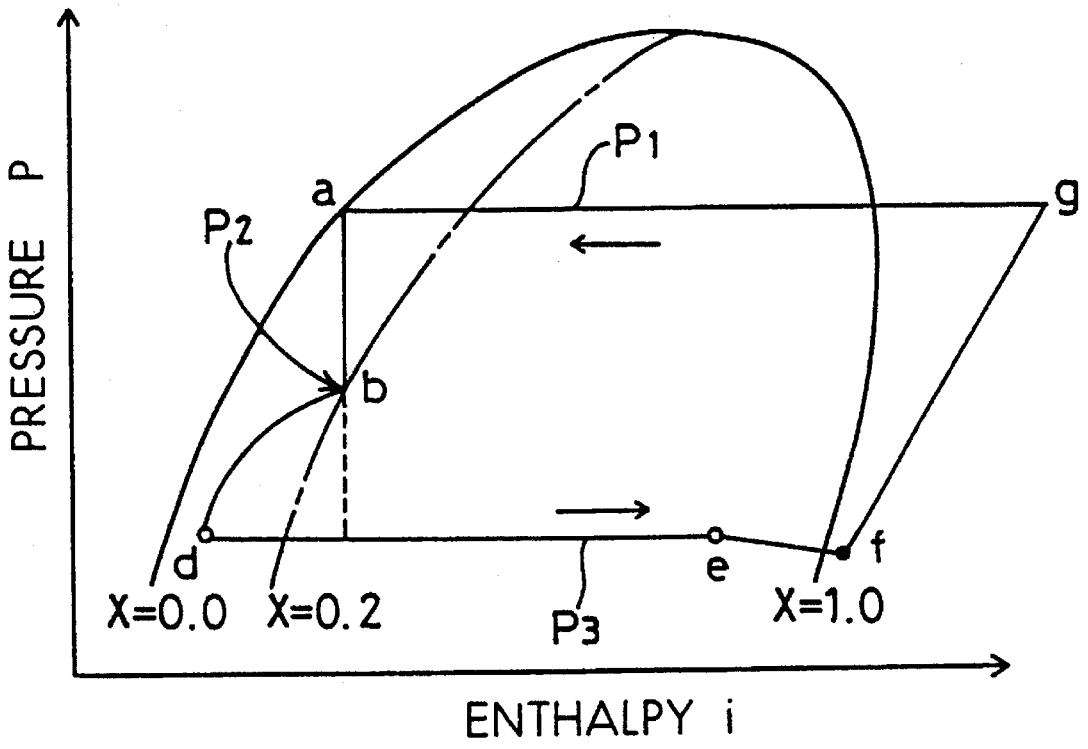
FIG. 17 is a graph illustrating the Mollier diagram of the refrigerating cycle in the summer season according to the first embodiment.

FIG. 16 illustrates schematically the refrigerating cycle construction when evaporator 316 of this embodiment is employed. As illustrated in FIG. 16, the evaporator 316 does not include the throttle portion 30 (FIG. 1) as pressure reducing means, and the pressure of the refrigerant is reduced when the refrigerant passes through cooled flow passage 328. The Mollier diagram of this refrigerating cycle in the summer season is as illustrated in FIG. 17. Specifically, when the refrigerant passes through cooled flow passages 28, the refrigerant is cooled and the pressure thereof is reduced at the same time (from the point b to the point d). Therefore, according to this embodiment, almost the same function as the first embodiment can be achieved without capillary flow passage 100 by providing thin groove 94, etc.

However, in a case where a throttle portion provided between the cooled flow passages and the inflow passages in the evaporating portion as a pressure reducing part like throttle portion 30 of the first embodiment is applied, the heat exchange efficiency in the heat exchanging portion can be improved and an evaporator for cooling apparatus, which is compact and high in heat exchange efficiency, can be obtained. On the other hand, when the cooled flow passages also function as pressure reducing means like the cooled flow passages 328 of the second embodiment, various modes of operations and effects that the number of parts and the manufacturing cost are reduced.

Figure 18:
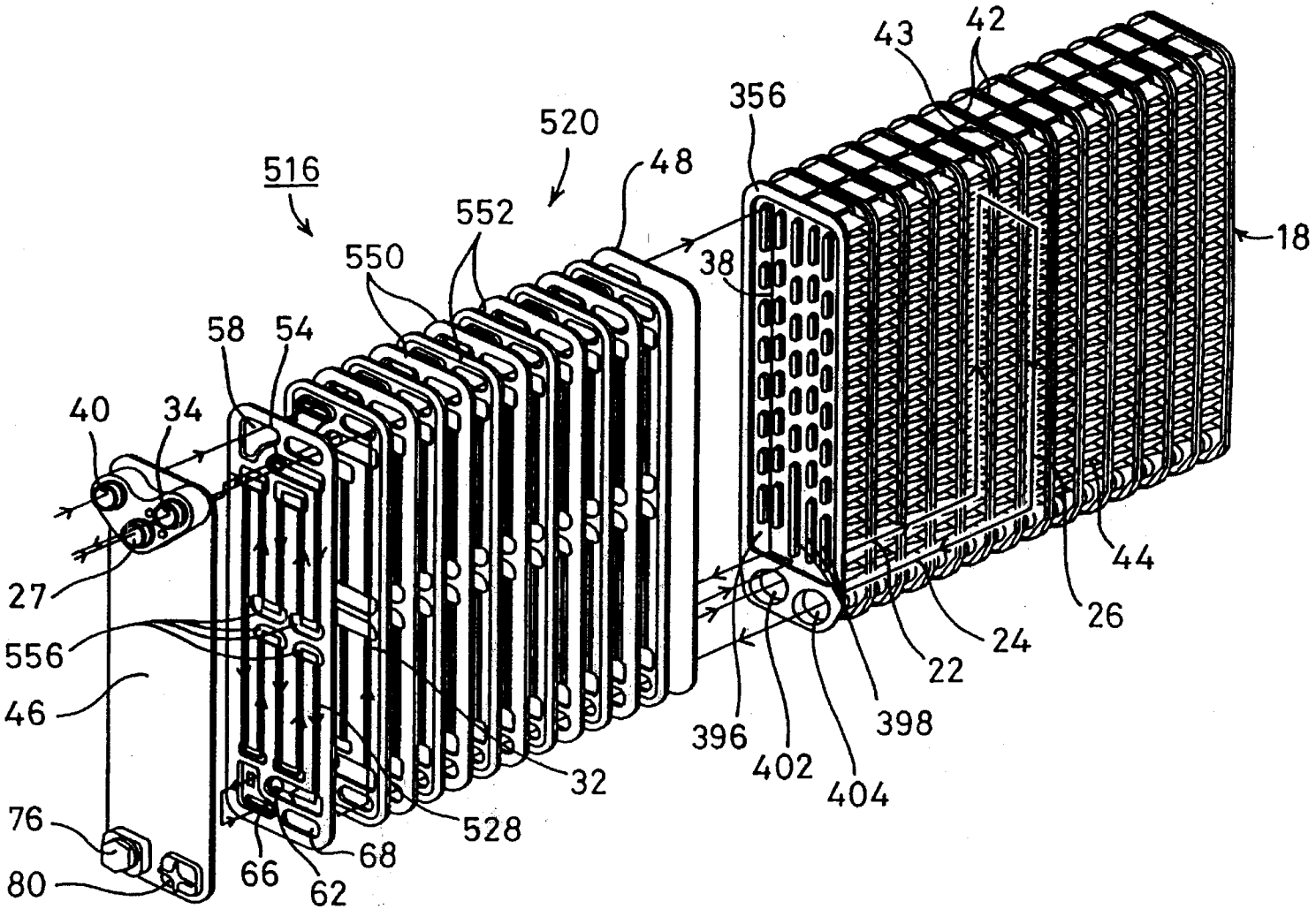
FIG. 18 is a perspective view illustrating the disassembled structure of an evaporator for cooling apparatus according to the third embodiment.

Furthermore, by extending the cooled flow passages from upper side inflow holes 54 to lower side inflow holes 62, the pressure reducing function can be provided to the cooled flow passages in the same way as the second embodiment. FIG. 18 is a perspective view illustrating the disassembled structure of evaporator 516 according to the third embodiment. In this embodiment, the same reference numerals as the first or second embodiment will be applied to those parts which are constructed in the same way as the first or second embodiment and the detailed embodiment thereof will be omitted.

As illustrated in FIG. 18, according to this embodiment, a plurality of pairs of first and second plates 550 and 552 are laminated between side plate 46 and center plate 48. Side plate 46 is laminated to evaporating portion 18 so as to hold fifth plate 356 therebetween, which is the same counterpart in the second embodiment. In this embodiment, the number of folded portions 556 of cooled flow passages 528 formed on the surfaces of first and second plates 550 and 552 is increased. In this way, the distance of cooled flow passages 528 from upper side inflow holes 54 to lower side inflow holes 62 between first and second plates 550 and 552 gets longer. As a result, flow resistance to the refrigerant throughout cooled flow passage 528 increases, and the function of the pressure reducing means can be provided to cooled flow passage 528 in the same way as the second embodiment. The Mollier diagram of the refrigerating cycle to which this embodiment is applied is also almost the same as that in FIG. 17.

Furthermore, it should be apparent to those skilled in the art that the present invention should not be limited to the above various embodiments but may be embodied in many other forms without departing from the spirit or the scope of the present invention.

For example, according to the present invention, the opening/closing of the bypass flow passage 38 is switched by constant pressure valve 40 using the refrigerant pressure P1 at the upstream side of expansion valve 6 as a pilot pressure. However, the opening/closing of the bypass flow passage 38 may be switched by electrically detecting the refrigerant pressure P1 such as pressure sensor and actuating a solenoid valve in accordance with the detection results. In each of the above embodiments where constant pressure valve 40 is used, the number of parts can be reduced as compared to a case where such pressure sensor is used, and therefore the structure can be simplified, and further the manufacturing cost can be reduced. On the other hand, when such pressure sensor is used, the opening/closing duty of the solenoid valve can be varied in accordance with the pressure P1, and precise control can be achieved.

Furthermore, in each of the above embodiments, bypass flow passage 38 is branched from the upstream side of the expansion valve 6. However, bypass flow passage 38 may be branched from the downstream side of expansion valve 6. In such a case, expansion valve 6 having a large valve diameter type is prepared so that a large flow rate can pass therethrough. It should be noted here that when bypass flow passage 38 is branched from the upstream side of expansion valve 6 according to each of the above embodiment, the diameter of valve 7 of expansion valve 6, which controls the refrigerant flow rate, may remain small, and therefore it is easy to control. On the other hand, when the bypass flow passage 38 is branched from the downstream side of expansion valve 6, all what to do is to constant valve 40 should have an only function of opening/closing bypass flow passage 38, thereby the structure being simplified.

Moreover, in each of the above embodiments, HFC-134a is used as refrigerant. However, any other type of refrigerant may be used. In such a case, the pressure for switching the opening/closing of constant pressure valve 40 is changed according to the employed refrigerant.

The present invention has been described in connection with what are presently considered to be the most practical preferred embodiments. However, the invention is not meant to be limited to the disclosed embodiments, but rather is intended to include all modifications and alternative arrangements included within the spirit and scope of the appended claims.

What is claimed is:

1. An evaporator for cooling apparatus comprising:

an evaporating portion having an inflow passage and an outflow passage, said inflow passage communicating in parallel with said outflow passage through a plurality of refrigerant flow passages;

a heat exchanging portion having a cooled flow passage arranged to lead to a pressure reducing valve for a refrigerating cycle and a cooling flow passage arranged to lead said outflow passage to introduce a refrigerant outside said heat exchanging portion, heat exchange being performed between said cooled flow passage and said cooling passage;

pressure reducing means for reducing a pressure of said refrigerant within said cooled flow passage to introduce said refrigerant to said inflow passage;

means for defining a bypass passage bypassing said heat exchanging portion and said pressure reducing means to introduce said refrigerant into said inflow passage; and a valve element disposed in said bypass passage and opening and closing said bypass passage in accordance with a refrigerant pressure at the upstream side of said pressure reducing valve.

2. An evaporator for cooling apparatus according to claim 1, wherein the valve element is a constant pressure valve which opens and closes by using the refrigerant pressure at the upstream side of said pressure reducing valve as a pilot pressure.

3. An evaporator for cooling apparatus according to claim 1, wherein said valve element opens said bypass passage when said refrigerant pressure at the upstream side of said pressure reducing valve is equal to or less than a predetermined pressure where a refrigerant temperature within said cooled flow passage is more than a refrigerant temperature within said cooled flow passage is more than a refrigerant temperature within said cooling flow passage when said refrigerant is introduced into said heat exchanging portion and where a refrigerant dryness is less than a predetermined value when said refrigerant is not introduced into said heat exchanging portion and pressure thereof is reduced directly to the refrigerant pressure within said evaporating portion.

4. An evaporator for cooling apparatus according to claim 3, wherein said refrigerant is HFC-134a, the refrigerant pressure in the evaporating portion is approximately 0.3 MPa (absolute pressure), and the specified pressure is 0.7±0.1 MPa (absolute pressure).

5. An evaporator for cooling apparatus according to claim 3, wherein said pressure reducing means reduces said pressure of said refrigerant within said cooled flow passage step by step.

6. An evaporator for cooling apparatus according to claim 5, wherein said pressure reducing means includes an expansion valve and a throttle valve between said evaporating portion and said heat exchanging portion.

7. An evaporator for cooling apparatus according to claim 6, wherein said throttle valve includes a capillary plate to form a capillary passage therein.

8. An evaporator for cooling apparatus according to claim 3, wherein said pressure reducing means reduces said pressure of said refrigerant within said cooled flow passage gradually.

9. An evaporator for cooling apparatus according to claim 8, wherein said pressure reducing means is provided in said cooled flow passage.

* * * * *